US005452493A

United States Patent [19]

Galindo

[11] Patent Number: 5,452,493

[45] Date of Patent: Sep. 26, 1995

[54] VACUUM CLEANER ATTACHMENT FOR CLEANING SMALL CREVICES OR THE LIKE, ATTACHABLE TO VACUUM EXTENSION HOSES OF DIFFERENT SIZES

[76] Inventor: Yvonne G. Galindo, 7267 Pajarito Rd. NE, Rio Rancho, N.M. 87124

[21] Appl. No.: 234,297

[22] Filed: Apr. 28, 1994

[51] Int. Cl.[6] ..... A47L 9/02

[52] U.S. Cl. ..... 15/414; 15/415.1

[58] Field of Search ..... 15/415.1, 393, 15/401, 414, 395, 1.7

[56] References Cited

U.S. PATENT DOCUMENTS

| | | | |
|---|---|---|---|
| 2,606,338 | 8/1952 | Lorenzo | 15/395 |
| 4,053,962 | 10/1977 | McDowell | 15/414 |
| 4,553,284 | 11/1985 | Strumbos | 15/415.1 |
| 4,575,423 | 3/1986 | Alanis et al. | 15/1.7 |
| 4,704,765 | 11/1987 | Ataka | 15/414 |

FOREIGN PATENT DOCUMENTS

| | | | |
|---|---|---|---|
| 642989 | 6/1962 | Canada | 15/414 |

*Primary Examiner*—Timothy F. Simone

*Assistant Examiner*—Reginald L. Alexander

*Attorney, Agent, or Firm*—Richard A. Bachand

[57] ABSTRACT

A vacuum cleaner attachment has an attachment cylinder and a plate enclosing one end of the attachment cylinder. A semi-rigid tube is attached to and extends from a front side of the plate. A flexible sheet is attached at a centrally located edge to a circumference portion of the attachment cylinder. A hook and loop fastener is attached to outside edges of the flexible sheet so that when the back side of the attachment cylinder is placed over an end of a vacuum cleaner hose, the flexible sheet may be wrapped around the vacuum cleaner hose and the hook and loop faster may be engaged to secure the attachment cylinder in place. Ridges may be provided along a central portion of a length of the tube to adjust the rigidity to the central portion of the tube, and top and bottom scrapper wings are attached adjacent an end of the tube away from the attachment cylinder. Additional, detachable cleaning elements, are also provided that have a securing cylinder of diameter larger than a diameter of the attachment cylinder to enable one end to slip fit over the attachment cylinder, the securing cylinder having axial slots to engage the wings to hold the securing cylinder in place on the attachment cylinder, and bristles carried on the securing cylinder on an end opposite the one end of the securing cylinder.

25 Claims, 3 Drawing Sheets

VACUUM CLEANER ATTACHMENT FOR CLEANING SMALL CREVICES OR THE LIKE, ATTACHABLE TO VACUUM EXTENSION HOSES OF DIFFERENT SIZES

BACKGROUND OF THE INVENTION

1. Field of the Invention

This invention relates to improvements in vacuum cleaner attachments, and, more particularly, to improvements in vacuum cleaner attachments of the type that can fit onto variously sized vacuum cleaner hoses, and that can accept and carry further or supplemental cleaner attachments, and which can reach into small spaces or crevices.

2. Relevant Background

Over the years, many sundry vacuum cleaner attachments have been proposed. Typically, a vacuum cleaner attachment attaches to a rigid portion of an extension hose from the vacuum source of the vacuum cleaner. Usually, the extension hose has a rigid plastic or metal end that receives the attachment, and a flexible portion along its length to enable the hose to be easily extended and manipulated to reach the area to be cleaned.

The mechanism by which the vacuum attachment and the end of the hose are attached is generally a tight friction fit between mating or interfitting portions of the attachment and the rigid portion of the hose. Sometimes a spring mounted button or protuberance is provided on the rigid portion of the hose that may be inserted into a retaining hole in the attachment when it is in place (or vice-versa, with a button on the attachment to mate with a hole on the hose), to provide a secure fitting, possibly in addition to the friction attachment mentioned above.

In all such attachment mechanisms, the vacuum attachment must be specially sized in order to properly fit onto the vacuum hose to provide an essentially airtight seal for efficient operation. Usually, in fact, individual vacuum cleaner manufacturers provide vacuum attachments that are specially made to fit the vacuum hoses provided with that particular manufacturer's products to assure proper operation and customer satisfaction.

Universal adapters have been proposed in the past that will fit onto various sized vacuum cleaner hoses; however, such attempts have usually resulted in relatively cumbersome, complicated, and expensive connection structures. Moreover, generally only a small range of vacuum hose diameters can be accommodated for satisfactory interfitting of the vacuum attachment to the vacuum hose.

The problems that arise in providing a suitable universal vacuum attachment mount are further aggravated when the attachment is sized for use in relatively small areas, such as window sill crevices, cracks, or the like. Of course small diameter tubes are widely used in such applications as dentist's evacuators, operating room aspirators, or the like. However, such uses generally are especially designed to be used in conjunction with specialized equipment for medical or dental office use, and are not of universal application. Nevertheless, in vacuum attachments that present a small cleaning opening, for example, on the order of about 1 cm., with an ability to couple to a vacuum cleaner hose, for example of diameter between about 3 cm. to 5 cm., the transition in diameter must be accomplished in a manner that will enable the small diameter tool to be properly manipulated.

With regard to the vacuum attachment end itself, often users abandon the attachment in frustration and use the end of the extension hose itself to reach into tight places, relying upon the force of the air drawn by the vacuum to pick up dust or particulates, even though the proximity of the hose to the region to be cleaned is not particularly close. Moreover, often the dirt or dust has become moist and is caked in place, requiring the user to scrape at the dust to break the crust to enable it to be removed. Users often use the rounded end of the vacuum cleaner hose for this purpose, but, of course, the results are not particularly satisfactory. Special "crevice attachments" have been used for this purpose that have a flattened elongated end, but they only marginally improve the results from using the extension hose end, primarily in enabling the vacuum to be extended closer to the dirt, especially in cracks or crevices of size larger than the crevice tool, but less than the end of the extension hose. The problems remain in those applications in which the dirt needs to be scraped or perturbed to enable removal.

Another problem that typically exists is that often cleaning challenges arise that cannot be solved by only a single attachment. For example, often both a scraper and a brush are needed to address a particular cleaning problem. In the past, separate attachments have been required to be individually attached and removed from the vacuum hose. This increases the needed arsenal of cleaning attachments to arm the user with sufficient tools to perform a broad range of cleaning chores, and, in view of the problems of achieving connections to a wide range of extension hose diameters, significantly increased the cost required to acquire the various vacuum attachments, for example, one for scraping, one for brushing, one having long bristles, one with short bristles, and so on.

SUMMARY OF THE INVENTION

In light of the above, therefore, it is an object of the invention to provide an improved vacuum cleaner attachment.

It is another object of the invention to provide an improved attachment of the type described that can be universally fit onto a vacuum cleaner extension hose within a wide range of diameters.

It is yet another object of the invention to provide an improved attachment of the type described that is capable of rapid and secure attachment and detachment to a vacuum cleaner extension hose.

It is yet another object of the invention to provide an improved attachment of the type described that facilitates cleaning in small or tight places, such as window frame recesses or the like.

It is still another object of the invention to provide an improved attachment of the type described that can provide a scraping or perturbing action against the dirt or dust to be removed, even in tight or close places.

It is yet another object of the invention to provide an improved attachment of the type described that can securely receive further cleaning attachments, and to provide such further cleaning attachments.

These and other objects, features and advantages of the invention will be apparent to those skilled in the art from the following detailed description of the invention, when read in conjunction with the accompanying drawings and appended claims.

In accordance with a broad aspect of the invention, a vacuum cleaner attachment is presented that has an attachment cylinder and a plate enclosing one end of the attachment cylinder. A tube, which may be of flexible material, is attached to and extends from a front side of the plate, the tube having an interior cavity along its length communicating with a back side of the plate. A flexible planar member, which may be a fabric sheet, or the like, is attached at a centrally located edge along a portion of the circumference of the attachment cylinder. A fastener, preferably a hook and loop fastener, is attached to outside edges of the flexible planar member. In operation, when the back side of the attachment cylinder is placed over an end of a vacuum cleaner extension hose, the flexible planar member may be wrapped around the end of the vacuum cleaner extension hose and the fastener engaged to secure the attachment cylinder to the vacuum cleaner extension hose. In one embodiment, ridges are provided along a central portion of a length of the tube to impart a degree of rigidity to the central portion of the tube. According to another embodiment, top and bottom scraper wings are attached adjacent an end of the tube away from the attachment cylinder. The scraper wings may have pointed tips, for instance, one being generally triangular shaped and attached at one side to the tube to stand within a plane encompassing a centerline of the tube, and the other being generally triangular shaped and is attached at one side to the tube to stand within a plane encompassing a centerline of the tube, an upstanding edge of the generally triangular shaped scraper wings being concavely shaped to provide a sharp point on the scraper wing. In yet another embodiment of the invention, an additional, detachable cleaning element, is provided that has a securing cylinder of diameter larger than a diameter of the tube to enable one end to be friction fit over the tube, the securing cylinder having axial slots to engage the wings to hold the securing cylinder in place on the tube, and bristles carried on the securing cylinder on an end opposite the one end of the securing cylinder.

BRIEF DESCRIPTION OF THE DRAWINGS

The invention is illustrated in the accompanying drawings, in which.

DETAILED DESCRIPTION OF THE PREFERRED EMBODIMENTS

Figure 1:
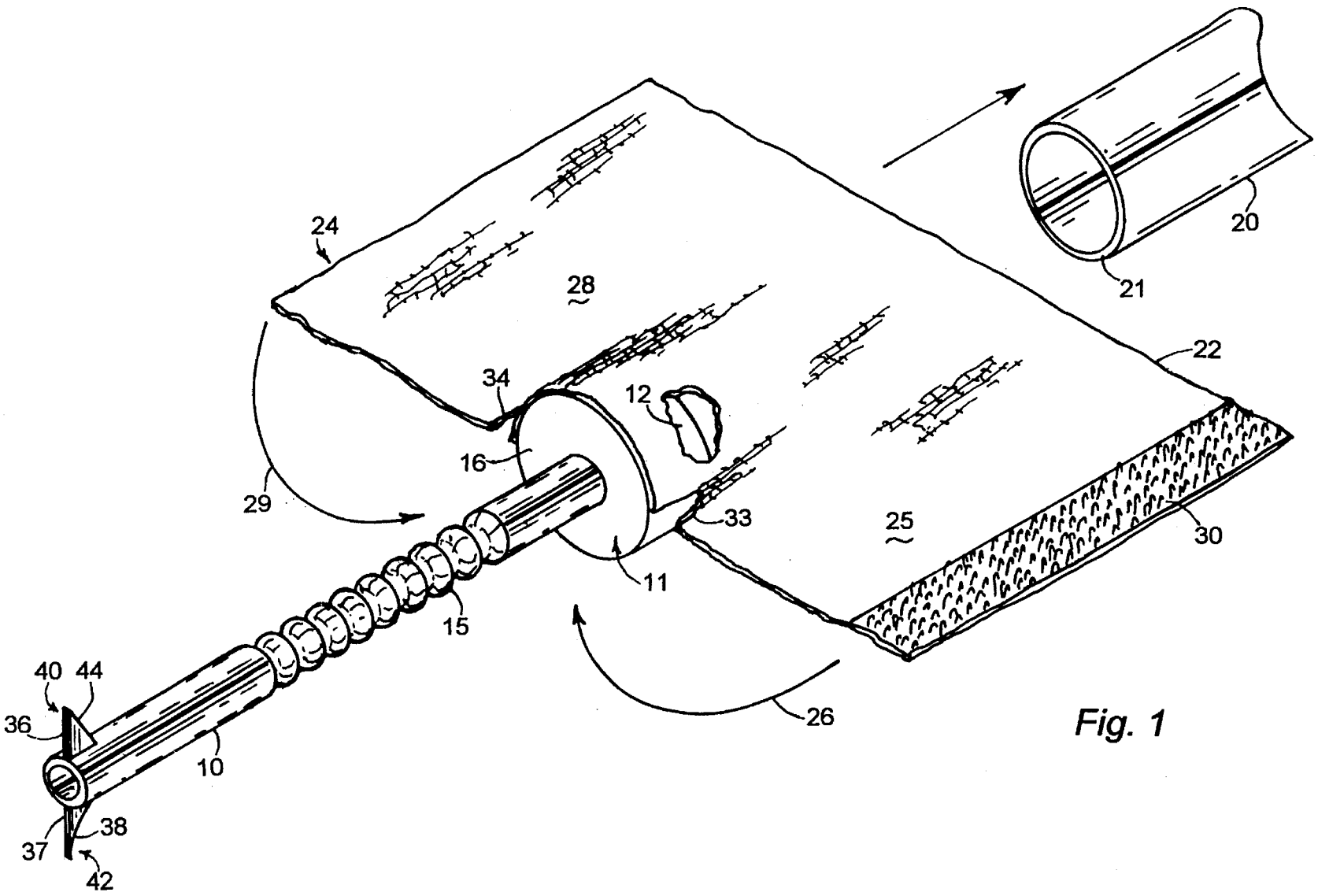
FIG. 1 is an isometric view of a vacuum attachment in accordance with a preferred embodiment of the invention, with fabric wings extended prior to mounting on an extension hose of a vacuum cleaner.

An isometric view of a vacuum attachment 5 in accordance with a preferred embodiment of the invention is shown in FIG. 1. The vacuum attachment 5 has a suction tube 10 attached to extend from a cup shaped attachment mount 11. The suction tube 10 may be a flexible material, such as plastic, vinyl, polyvinyl chloride (PVC), or the like, its degree of flexibility being selected to enable the suction tube to be manipulatable to reach to desired regions to be cleaned, such as window frame elements, or the like, yet enabled to be sufficiently non-compliable to allow the scraper elements 40 and 42 to be effective. If desired, the tube 10 may have a circular cross-sectional shape, and may have a number of ridges 15 formed midway along its length, as shown, to enhance the handlability of the tube, and to enable the tube to better flex as needed. The ridges 15 may be formed of the same material as the suction tube 10, preferably molded as an integral part of the suction tube 10 during its fabrication. Although the suction tube 10 may be of length chosen for the particular anticipated application, preferably it is about 10 cm. long, with the ridge portion extending about 6 cm., the forward portion extending about 2.5 cm., and the rearward portion extending about 1.5 cm. The thickness of the tube 10 may be, for example, between 1 mm. and 2 mm., and its diameter may be, for instance, between about 1 cm. and 2 cm.

The attachment mount 11 may also be of plastic, vinyl, PVC, or the like, but constructed to have sufficient rigidity to support the suction tube 10. The attachment mount 11 has a planar front face plate 16 that can be brought into sealing engagement with a front portion 21 of the extension hose 20 from the vacuum cleaner (not shown), and may be of size substantially larger than the diameter of the tube 10, for example having a diameter of about 6.5 cm. The sealing engagement is held in place, in part, by the suction of the vacuum against the front face plate 16, which forces the face plate 16 against the surface 21. The vacuum tube 10 has an interior cavity along its length communicating with a back side of the front face plate 16, so that the vacuum within the extension hose 20 is transmitted along the vacuum tube 10 when the vacuum attachment 5 is mounted in its operating position on the vacuum hose 20.

The attachment mount 11 has a rearwardly extending, cylindrically shaped lip 12, seen in the cutaway portion of the flexible wings 24 in FIG. 1, that encircles the end of the extension hose 20 when the vacuum attachment 5 has been placed in operating position. The purpose of the cylindrically shaped lip 12, in part is to hold the flexible wings 24 to the attachment mount 11 so that the vacuum attachment 5 can be further maintained in its operating position on the vacuum hose 20, shown in FIG. 2, as will become apparent.

Figure 2:
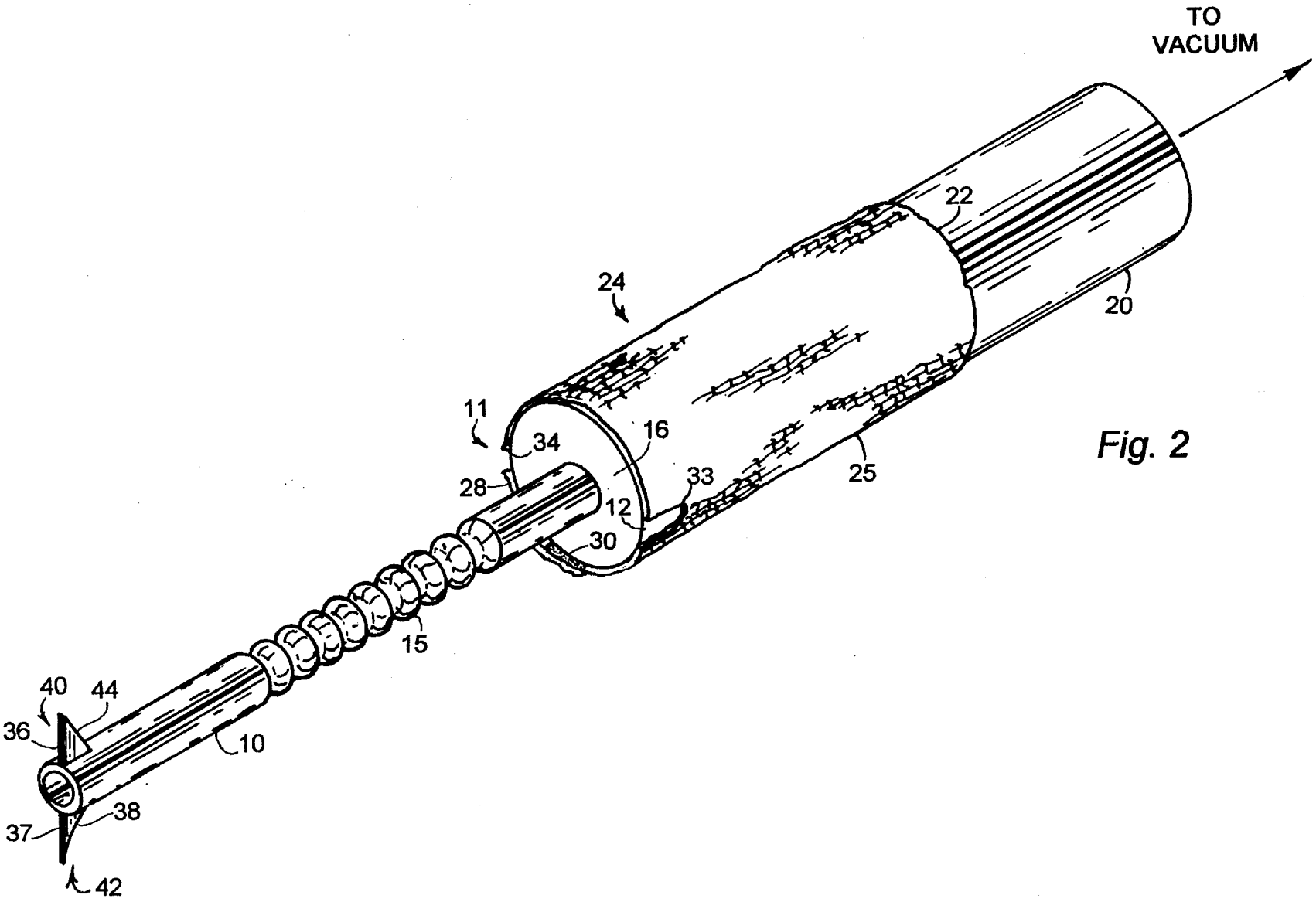
FIG. 2 is an isometric view of the vacuum attachment of FIG. 1, with the fabric wings configured to secure the attachment to an extension hose of a vacuum cleaner in an operating position of the vacuum attachment.

The flexible wings 24 are provided by a square or rectangular piece of fabric, plastic, oilcloth, or other suitable flexible material that can easily be wrapped around the extension hose 20 when the vacuum attachment 5 is located in its operating position, shown in FIG. 2. The flexible wings 24 may be sized, for example, to have a width (transverse to the centerline of the tube 10) of about 30 cm. and length (parallel to the centerline of the tube 10) of about 10 cm. The flexible wings 24 are affixed to a portion of the cylindrically shaped lip 12, such as along the top half of its circumference, as shown, by glue, staples, rivets, or other suitable fastening means.

The flexible wings 24 have left 25 and right 28 portions that are sized sufficiently to partially overlap when the vacuum attachment 5 is in its operating position on the vacuum hose 20. The flexible wings 24 are held in their overlap position by a fastener, preferably a hook and loop fastener as shown. Thus, a strip 30 presenting the hook part of the fastener is attached to the outside edge of the left wing 25, and the loop portion (not shown) is attached to the underside of the right wing portion 28. The strip 30 may be about 2.5 cm. wide, and extend the length of the wing 25. Depending upon the type of material used in the construction of the flexible wings 24, the loop portion of the hook and loop fastener may be provided by the flexible wing material itself, suitable fabrics or materials for this purpose being known. It will therefore be appreciated that the flexible wings 24 enable the vacuum attachment 5 to be held in operating position on vacuum hoses within a wide range of diameters, yet enables rapid mounting and demounting of the attachment from the vacuum hose, as needed. If desired, cut-out portions 33 and 34 may be provided at the front edge of the flexible wings 24 adjacent the location at which the flexible wings are attached to the cylindrically shaped lip 12. Although not essential, the recesses assist the flexible wings 24 accommodate attachment of the vacuum attachment 5 to smaller diameter vacuum hoses 20, without forming ridges or outstanding bunches of flexible material along the circumference of the cylindrically shaped lip 12 when the vacuum attachment 5 is in operating position.

Thus, to mount the vacuum attachment 5 to the extension hose 20, the flexible wings 24 are extended to the positions shown in FIG. 1, and the planar front face plate 16 of the attachment mount 11 brought into sealing contact with the front edge 21 of the extension hose 20. The left wing 25 of the flexible wings 24 is formed around the left side of the extension hose 20, in the direction of the arrow 26. The right wing 28 of the flexible wings 24 is then formed around the right side of the extension hose 20 in the direction of the arrow 29, bringing the hook portion 30 of the hook and loop fastener into engagement with the loop portion (or the equivalent fabric structure) on the underside of the right wing 28 to secure the vacuum attachment 5 in place. It should be noted that although the extension hose 20 is described herein as being of circular shape, or having a particular diameter, consistent with most widely available extension hoses, it need not have any particular cross-sectional shape in order for the vacuum attachment of the invention to adequately be attached. Thus, the extension hose can be of square, elliptical, or other cross-sectional shape.

As mentioned, one of the cleaning problems that is frequency encountered is the need to scrape or perturb dust or dirt in order to dislodge it for removal. To enable such scraping, protruding wings or tips 40 and 42 of generally triangular shape are mounted to the top and bottom of the vacuum tube 10. The protruding tips 40 and 42 are preferably thin members aligned within the centerline plane of the vacuum tube 10. Although the precise shape of the protruding tips 40 and 42 may be selected depending upon their anticipated use, preferably they are shaped as shown with one tip, for example the bottom tip 42, having straight edges suitable for scraping along either the forward edge 37 or rearward edge 38, and with the other tip, for example the top tip 40, shaped with at least one edge, such as the rearward edge 44 concavely shaped to define a sharp point at the intersection of the forward edge 36 and rearward edge 44.

Figure 3:
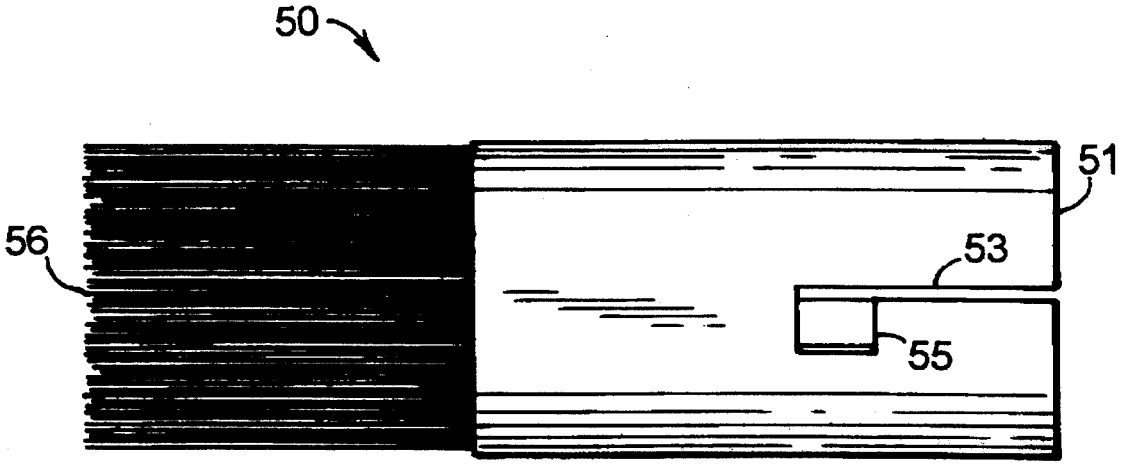
FIG. 3 is a plan view of a brush attachment that can be mounted onto the vacuum attachment of FIG. 1.

The protruding tips 40 and 42 also serve as securing locks for additional "piggyback" vacuum attachments, as next described. Thus, for example, as shown in FIG. 3, a piggyback brush attachment 50 is shown. The brush attachment 50 has a hollow cylindrical base 51 that has an inside diameter just slightly larger than the outside diameter of the vacuum tube 10, shown in FIG. 1 to enable the cylindrical base to slide over the vacuum tube 10 and to be held in place by a friction fit between the two parts. A pair of slots 53 are provided partially along the length of the top and bottom of the cylindrical base 51 to allow the protruding tips 40 and 42 to pass therealong as the cylindrical base 51 is slid into place on the vacuum tube 10. If desired, sideward extending slots 55 may be provided, as shown, to receive the protruding tips 40 and 42 as the cylindrical base 51 is rotated to lock the piggyback attachment in place.

The forward end of the cylindrical base 51 carries a plurality of bristles 56 for sweeping or loosening dirt, for example, as may be found in computer keyboards, or the like. The bristles may be designed with hard or soft bristles, or of various lengths, as needed for the particular application envisioned.

Figure 4:
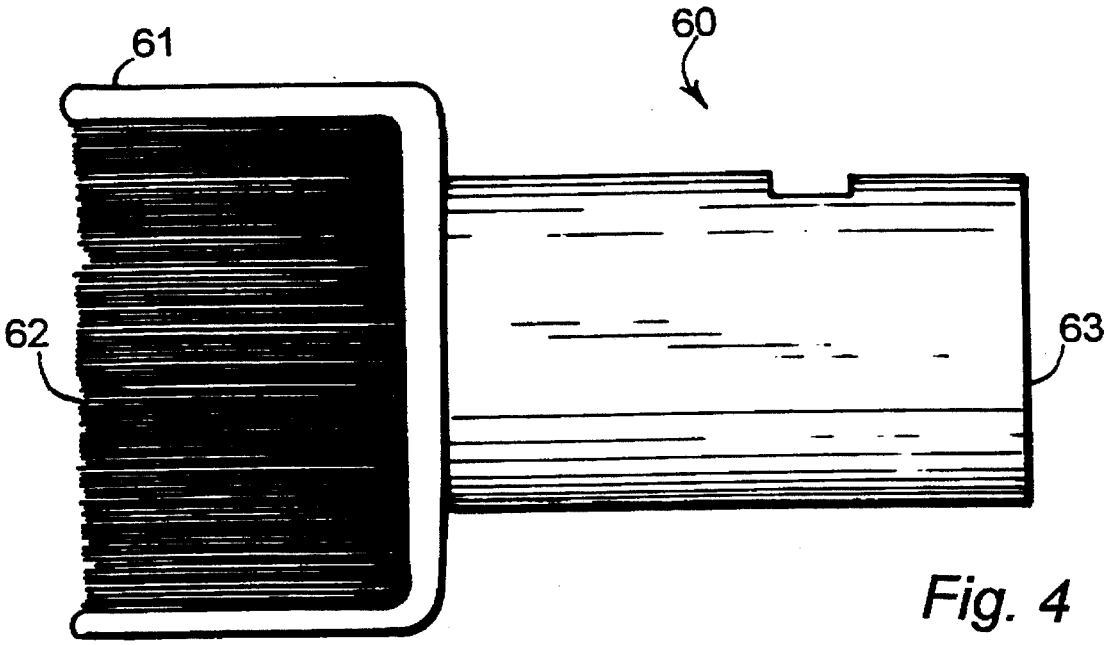
FIG. 4 is a side elevation view of another brush attachment that can be mounted onto the vacuum attachment of FIG. 1.

Another piggyback attachment 60, shown in FIG. 4, is constructed similarly to the piggyback attachment of FIG. 3, except a "U" shaped channel 61, of hard plastic, rubber, or similar material is provided to carry the bristles 62 on a cylindrical base 63. The cylindrical base 62, is constructed in substantially the same manner as the cylindrical base 51 described above with respect to FIG. 3, and is in vacuum communication with the interior of the channel 61. The piggyback attachment 60 may be used, for example, in cleaning miniblinds, or similar articles.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. A vacuum attachment, comprising:

an attachment cylinder;

a plate enclosing one end of said attachment cylinder, said plate having a hole therethrough for airflow through said plate to within said attachment cylinder;

a tube attached to and extending from a front side of said plate, said tube having an interior cavity along its length communicating with the hole in said plate;

a flexible planar member attached at a centrally located edge to at least a portion along a circumference of said attachment cylinder;

a hook and loop fastener attached to outside edges of said flexible planar member, whereby when said back side of said attachment cylinder is placed over an end of a vacuum extension hose, said flexible planar member may be wrapped around the end of said vacuum extension hose and said hook and loop fastener may be engaged to secure the vacuum attachment to said vacuum extension hose.

2. The vacuum cleaner attachment of claim 1 wherein said flexible planar member is a fabric sheet.

3. The vacuum cleaner attachment of claim 1 wherein said tube is of a flexible material.

4. The vacuum cleaner attachment of claim 3 further comprising ridges along a central portion of a length of said tube.

5. The vacuum cleaner attachment of claim 3 wherein said tube is flexible plastic.

6. The vacuum cleaner attachment of claim 3 wherein said attachment cylinder is hard plastic.

7. The vacuum cleaner attachment of claim 5 further comprising top and bottom scrapper wings attached adjacent an end of said tube away from said attachment cylinder.

8. The vacuum cleaner attachment of claim 7 wherein at least one of said scrapper wings is generally triangular shaped and is attached at one side to said tube to stand within a plane encompassing a centerline of said tube.

9. The vacuum cleaner attachment of claim 7 wherein at least one of said scrapper wings is generally triangular shaped and is attached at one side to said tube to stand within a plane encompassing a centerline of said tube, an upstanding edge of said generally triangular shaped scrapper wings being concavely shaped to provide a sharp point on said scrapper wing.

10. The vacuum cleaner attachment of claim 7 further comprising a detachable piggyback attachment comprising, a securing cylinder of diameter larger than a diameter of said tube to enable one end to be emplaced over said tube with a friction fit, said securing cylinder having axial slots to engage said wings to hold said securing cylinder in place on said tube, and bristles carried on said securing cylinder on an end opposite said one end of said securing cylinder.

11. A vacuum attachment for mounting onto a vacuum extension hose, comprising:

an attachment mount including a cylindrical portion and a plate portion, said plate portion enclosing one end of said cylindrical portion, and having a back side for engaging an end of said vacuum extension hose, said plate having a hole therethrough for airflow through said plate to within said cylindrical portion;

a tube extending from a front side of said plate portion, said tube having an interior cavity along its length communicating with the hole in said plate portion;

a flexible fabric sheet winged member attached to said cylindrical portion; and a fastener attached to said flexible winged member, whereby when said back side of said plate portion is placed adjacent an end of said vacuum extension hose, said flexible winged member may be wrapped around said vacuum extension hose and said fastener may be engaged to secure the vacuum attachment to said vacuum extension hose.

12. The vacuum cleaner attachment of claim 11 wherein said fastener is a hook and loop fastener.

13. The vacuum cleaner attachment of claim 11 wherein said tube is of a flexible material.

14. The vacuum cleaner attachment of claim 13 further comprising ridges along a central portion of a length of said tube.

15. The vacuum cleaner attachment of claim 13 wherein said tube is plastic.

16. The vacuum cleaner attachment of claim 11 further comprising top and bottom protruding tips attached adjacent an end of said tube away from said attachment mount.

17. The vacuum cleaner attachment of claim 16 wherein at least one of said protruding tips is generally triangular shaped and is attached at one side to said tube to stand within a plane encompassing a centerline of said tube.

18. The vacuum cleaner attachment of claim 16 wherein at least one of said protruding tips is generally triangular shaped and is attached at one side to said tube to stand within a plane encompassing a centerline of said tube, an upstanding edge of said generally triangular shaped scrapper wings being concavely shaped to provide a point on said protruding tip.

19. A vacuum attachment for mounting onto a vacuum extension hose, comprising:

an attachment mount including a cylindrical portion and a plate portion, said plate portion enclosing one end of said cylindrical portion, and having a back side for engaging an end of said vacuum extension hose, said plate having a hole therethrough for airflow through said plate to within said cylindrical portion;

a tube extending from a front side of said plate portion, said tube having an interior cavity along its length communicating with said hole in said plate;

top and bottom protruding tips attached adjacent an end of said tube away from said attachment mount, wherein at least one of said protruding tips is generally triangular shaped and is attached at one side to said tube to stand within a plane encompassing a centerline of said tube, an upstanding edge of said generally triangular shaped scrapper wings being concavely shaped to provide a point on said protruding tip;

a flexible winged member attached to said cylindrical portion; and a fastener attached to said flexible winged member, whereby when said back side of said plate portion is placed adjacent an end of said vacuum extension hose, said flexible winged member may be wrapped around said vacuum extension hose and said fastener may be engaged to secure the vacuum attachment to said vacuum extension hose.

20. The vacuum cleaner attachment of claim 19 further comprising a detachable piggyback attachment, said piggyback attachment comprising, a securing cylinder of diameter larger than a diameter of said tube to slip fit over said tube, said securing cylinder having axial slots to engage said protruding tips to hold said securing cylindrical in place on said tube, and bristles carried on said securing cylinder on an end opposite said one end of said securing cylinder.

21. The vacuum cleaner attachment of claim 19 wherein said fastener is a hook and loop fastener.

22. The vacuum cleaner attachment of claim 19 wherein said tube is of a flexible material.

23. The vacuum cleaner attachment of claim 22 further comprising ridges along a central portion of a length of said tube.

24. The vacuum cleaner attachment of claim 22 wherein said tube is plastic.

25. The vacuum cleaner attachment of claim 19 further comprising top and bottom protruding tips attached adjacent an end of said tube away from said attachment mount.

* * * * *